US006159285A

United States Patent [19]

Toombs et al.

[11] Patent Number: 6,159,285

[45] Date of Patent: Dec. 12, 2000

[54] CONVERTING <100> AND <111> INGOTS TO <110> INGOTS

[75] Inventors: Marshall P. Toombs, Spotsylvania; Thomas G. Digges, Jr., Fredericksburg, both of Va.

[73] Assignee: Virginia Semiconductor, Inc., Fredericksburg, Va.

[21] Appl. No.: 09/306,669

[22] Filed: May 6, 1999

Related U.S. Application Data

[60] Provisional application No. 60/084,521, May 7, 1998.

[51] Int. Cl.[7] ..... B24B 5/00

[52] U.S. Cl. ..... 117/35; 117/41; 117/902

[58] Field of Search ..... 117/35, 41, 902

[56] References Cited

U.S. PATENT DOCUMENTS 3,929,528 12/1975 Davidson et al. ..... 148/175

5,069,743 12/1991 Wysocki et al. ..... 156/620.7

5,851,928 12/1998 Cripe et al. ..... 438/748

*Primary Examiner*—Felisa Hiteshew

*Attorney, Agent, or Firm*—Fish & Richardson P.C.

[57] ABSTRACT

A new ingot of a desired orientation formed from an original ingot of a different orientation by cutting the new ingot from within the original ingot. In one aspect, to form a <110> ingot from a <100> ingot, a {110} flat is formed on the <100> ingot. The flat is used as a reference for cutting the <100> ingot. The <100> ingot is cut into sections by cutting in a plane perpendicular to the <100> ingot's longitudinal axis and to the flat. A <110> ingot can be formed by grinding a section of the <100> ingot to form a new cylinder. The new cylinder has a longitudinal axis which is perpendicular to the <100> ingot's longitudinal axis and to the flat. The resulting cylinder is a <110> ingot.

25 Claims, 3 Drawing Sheets

CONVERTING <100> AND <111> INGOTS TO <110> INGOTS

This application claims the benefit of U.S. Provisional Application Ser. No. 60/084,521, filed May 7, 1998.

TECHNICAL FIELD

The present disclosure relates to silicon crystal ingots, and more particularly to forming silicon crystal ingots having a desired crystal orientation.

BACKGROUND

The microelectronic and semiconductor industries often use starting material, such as silicon crystal ingots, in manufacturing various devices. Applications of this starting material, such as micromachined devices, sometimes require wafers having special crystal orientations, such as {110} (a "{110} wafer").

Fabrication of starting material having a special orientation typically requires low oxygen concentration material because of etch artifacts. These etch artifacts can be caused by agglomerations of oxygen in the crystalline material and are detrimental to producing the desired orientation. This problem is described further by D. L. Kendall and R. A. Shoultz in "Handbook of Microlithography, Micromachining, and Microfabrication", Vol. II: Micromachining and Microfabrication SPIE Press, September 1997.

Low oxygen concentration in silicon can be achieved by float-zone ("FZ") growth. However, FZ <110> ingots from which {110} wafers can be cut are not readily available in the current market. Furthermore, cutting <100> or <111> ingots using a conventional technique to form {110} wafers is inefficient.

SUMMARY

The present disclosure describes methods and apparatus for forming a new ingot of a desired orientation from an original ingot of a different orientation by cutting the new ingot from within the original ingot. The inventors note that conventional saws do not turn the crystal axis enough to cut <110> wafers from <100> or <111> ingots. Wafers cut at a slant would require reshaping from elliptical to circular form. In one aspect, to form a <110> ingot from a <100> ingot, a {110} flat is formed on the <100> ingot. The flat is used as a reference for cutting the <100> ingot. The <100> ingot is cut into sections by cutting in a plane perpendicular to the <100> ingot's longitudinal axis and to the flat. A <110> ingot can be formed by grinding a section of the <100> ingot to form a new cylinder. The new cylinder has a longitudinal axis which is perpendicular to the <100> ingot's longitudinal axis and to the flat. The resulting cylinder is a <110> ingot.

A similar technique applies to forming a <110> ingot from a <111> ingot.

DETAILED DESCRIPTION

Figure 1:
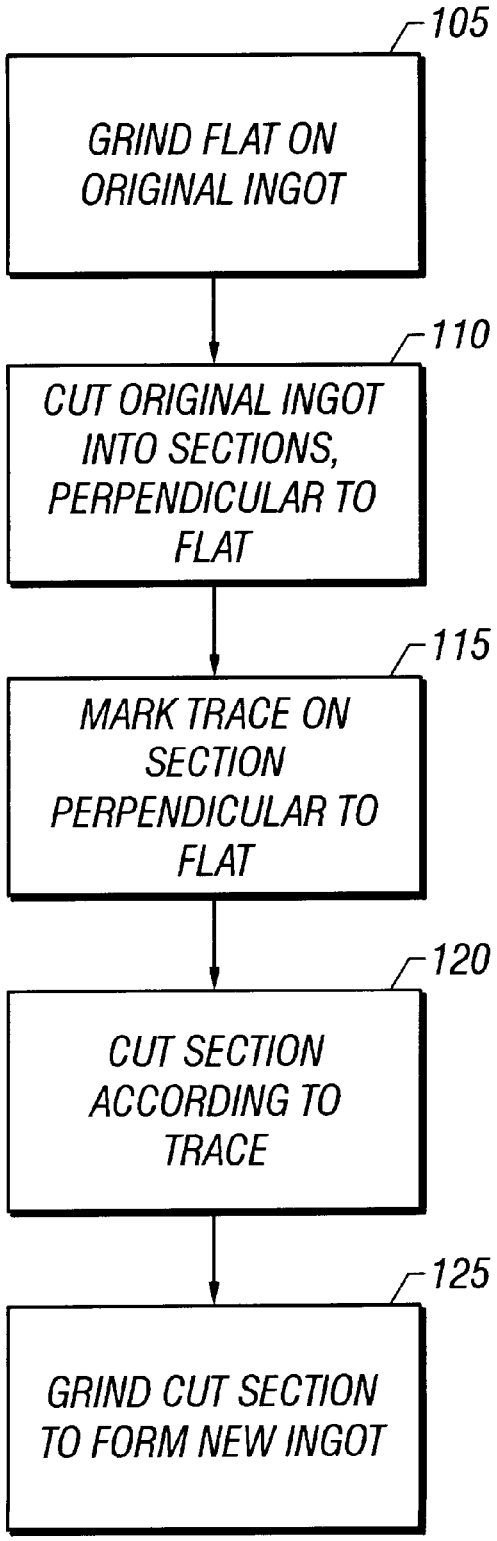
FIG. 1 is a flowchart of forming a <110> ingot from a <100> ingot.

FIG. 1 is a flowchart detailing the steps of forming a new <110> ingot from an original <100> ingot. FIGS. 2–5 illustrate the application of steps shown in FIG. 1. Using a {110} flat in the original <100> ingot as a reference, the new <110> ingot can be cut from within the original <100> ingot. This technique provides a cost-effective method of converting float-zone <100> ingots in common use to <110> ingots for special purpose applications.

The original <100> ingot is a cylindrical silicon ingot with a longitudinal axis parallel to the direction [100]. These orientations are exemplary and not limiting. For an ingot having a desired resulting orientation different from <110>, an original ingot having a different orientation from <100> may be appropriate. The <100> ingot has a diameter larger than both the length and diameter of the desired <110> ingot.

In the <100> ingot, there are four {110} face locations around the cylinder that are parallel to each specific <100> axis. One of these faces is selected. A {110} flat is ground upon that face, step 105. The flat can be ground by the manufacturer of the <100> ingot or later. Because the {110} flat is perpendicular to the <110>direction, the {110} flat can serve as a reference for forming a new <110> ingot. For example, if the original specific axis of the ingot is called [100], any of the faces $(0\bar{1}1)$, (011), $(01\bar{1})$, or $(0\bar{1}\bar{1})$ may be chosen for grinding the flat. Any of these flats can serve as a reference for forming a new ingot having an orientation of <110>.

Figure 2:
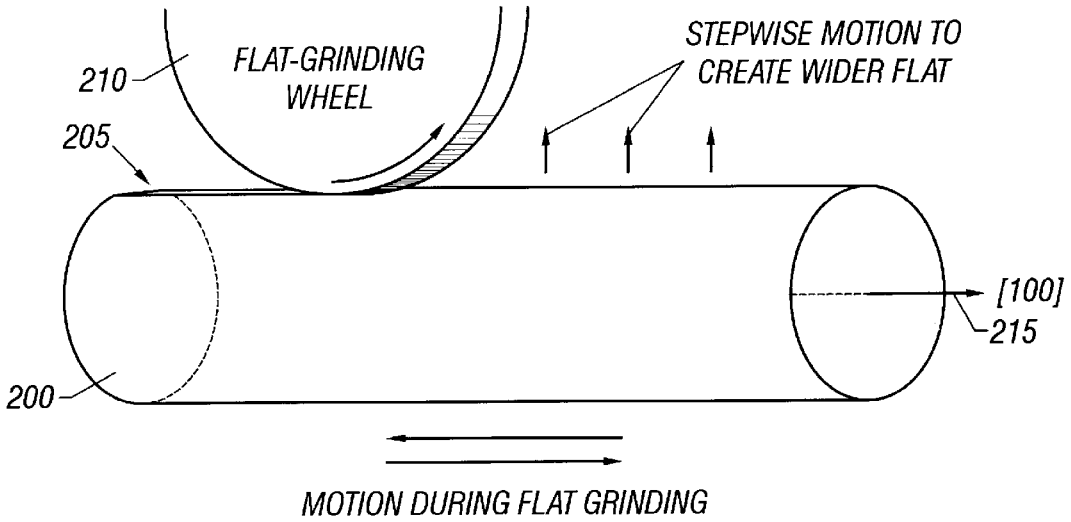
FIG. 2 illustrates forming a flat on a <100> ingot.

FIG. 2 illustrates forming a flat 205 on a <100> ingot 200. Ingot 200 is brought into contact with a spinning flat grinding wheel 210 and moved to form flat 205 along the length of ingot 200. Wheel 210 can be a conventional surface grinder such as a diamond-impregnated wheel with a flat periphery. Ingot 200 is moved so that a central axis 215, parallel to [100], is brought closer to wheel 210 in stages. As axis 215 is brought closer, wheel 210 causes the width of flat 205 to increase. The grinding continues until flat 205 has a desired width.

After forming the flat on the original <100> ingot, the <100> ingot is cut into two or more sections, step 110. The cuts can be made with a conventional technique. A cut is made in a plane perpendicular to the surface of the flat and the central axis of the original ingot. Each section is for a separate new ingot and so has a length greater than the desired diameter of a new ingot. Depending upon the length of the original ingot, however, either or both end sections may be discarded as too small.

Figure 3:
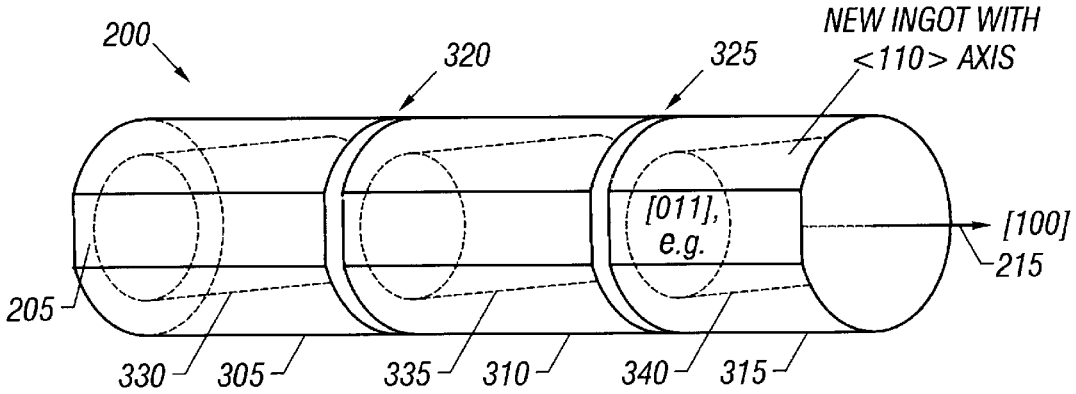
FIG. 3 shows a <100> ingot cut into sections.

FIG. 3 shows the <100> ingot 200 of FIG. 2 cut into three sections 305, 310, and 315. A cut 320 wa3 made between sections 305 and 310 and a cut 325 was made between sections 310 and 315. Cuts 320 and 325 are in parallel planes and are both perpendicular to the surface of flat 205 and central axis 215 in ingot 200. Dashed lines 330, 335, and 340 represent the new ingots to be cut from sections 305, 310, and 315, respectively. Thus, new ingots 330, 335, and 340 each have a longitudinal axis perpendicular to flat 205 and central axis 215 of ingot 200 and so have a crystal orientation of <110>.

After cutting the original ingot into sections, each section is marked with a template having a circular cross-section to form a trace indicating the shape of the new ingot inside the section of the ingot, step 115. The template can be formed from any tubular material and shaped to fit the curvature of the section. The template is placed centrally over the surface of the flat on the section and traced with a pen or other marking device to mark a circular trace on the section. This trace indicates from which portion of the section material is not to be removed when cutting and grinding the section.

Figure 4:
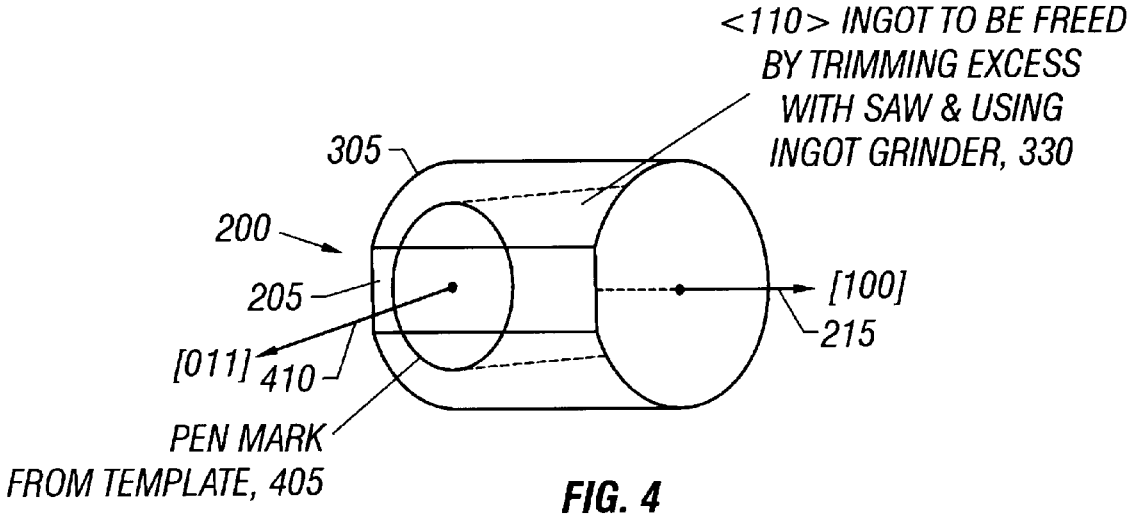
FIG. 4 shows a section of a <100> ingot indicating from where a <110> ingot can be cut.

FIG. 4 shows the section 305 of the <100> ingot 200 marked to indicate from where the new <110> ingot 330 can be cut (recall FIGS. 2 and 3). A circular trace 405 has been marked upon section 305. Trace 405 is centered upon a central axis 410 of new ingot 330 within section 305. Central axis 410 is in direction [011] and perpendicular to {110} flat 205 and [100] central axis 215 of <100> ingot 200.

After marking the section, the section is cut so that the section roughly conforms to the marked trace for the new <110> ingot, step 120. The cuts can be made with a conventional silicon cut-off saw by securing the flat perpendicular to the cutting direction and making rough cuts to trim the section to conform to the trace. Thus, these cuts are perpendicular to the {110} flat and parallel to the central [011] axis of the new <110> ingot.

Figure 5:
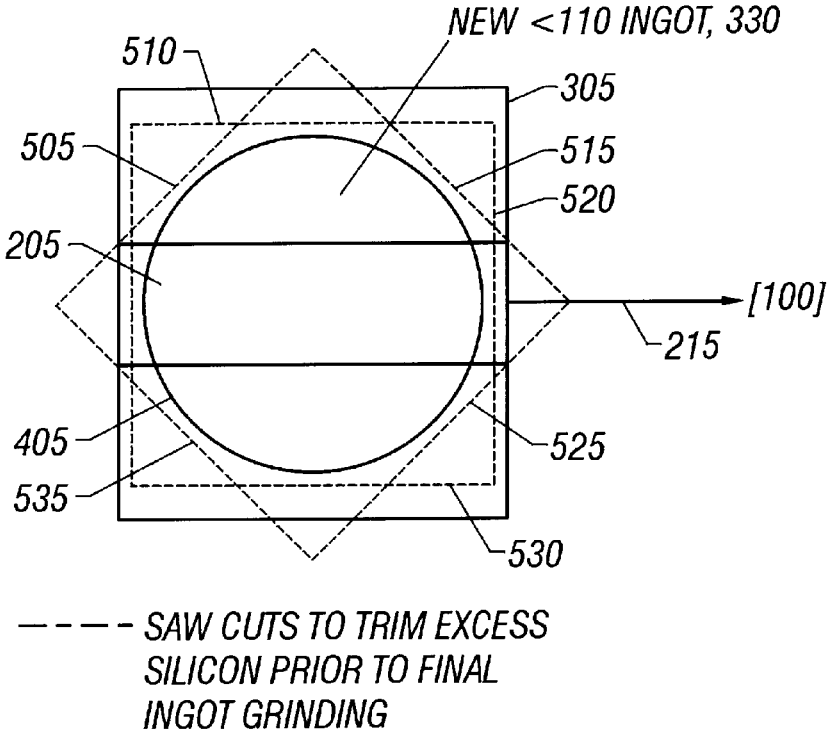
FIG. 5 shows saw cuts to be applied to a section of a <100> ingot.

FIG. 5 shows saw cuts 505, 510, 515, 520, 525, 530, and 535 to be applied to section 305 of <100> ingot 200 according to trace 405 (recall FIGS. 2–4). Cuts 505–535 are made to remove excess material to form a rough version of new ingot 330. Cuts 505–535 illustrate one way of trimming excess material, but numerous variations are possible.

After cutting the section, the rough <110> ingot is ground to form the new <110> ingot, step 125. The grinding can be performed conventionally, such as with a centerless grinder or a center grinder. Depending upon the cutting and grinding techniques used, these shaping steps can be performed separately or together.

In application, the resulting <110> ingot can be ground forming an appropriate flat and cut into wafers.

The present disclosure has described an exemplary implementation of a technique for forming a new ingot of a desired orientation from an original ingot of a different orientation by cutting the new ingot from within the original ingot. However, variations of this technique are possible and are within the scope of the present disclosure. For example, the original ingot can be marked before being cut into sections. If only a single new ingot is desired, it is not necessary to cut the original ingot into sections. The technique can be applied to forming a <110> ingot from a <111> ingot as well. Different combinations of orientations are also possible. In addition, the technique is applicable to crystal materials other than silicon.

What is claimed is:

1. A method of forming a new ingot having a target orientation from an original ingot having an original orientation, comprising:

grinding a flat on the original ingot, where the flat defines a flat plane parallel to an original longitudinal axis of the original ingot;

cutting the original ingot into a plurality of sections, where each cut is made in a respective cutting plane which is perpendicular to the original longitudinal axis and the flat plane;

marking each section with a respective circular trace using the flat as a reference, where each respective trace is centered upon a new longitudinal axis of a new ingot to be formed from the respective section, where the new longitudinal axis is perpendicular to the flat plane and is perpendicular to the original longitudinal axis;

removing material outside the trace from each section by cutting the respective sections, where each cut is made in a plane perpendicular to the flat plane; and removing material outside the trace from each section to form a respective new ingot from each section.

2. The method of claim 1, where the original ingot has a crystal orientation of <100> and the new ingot has a crystal orientation of <110>.

3. The method of claim 2, where the flat is a {110} face.

4. The method of claim 1, where the original ingot has a crystal orientation of <111> and the new ingot has a crystal orientation of <110>.

5. The method of claim 4, where the flat is a {110} face.

6. The method of claim 1, where the original ingot is a silicon crystal ingot.

7. The method of claim 1, where the original ingot is a float-zone ingot.

8. An ingot formed by the method of claim 1.

9. A silicon <110> ingot formed from a silicon <100> ingot by the method of claim 1.

10. A silicon <110> ingot formed from a silicon <111> ingot by the method of claim 1.

11. A method of forming a new ingot having a target orientation from an original ingot having an original orientation, where the original ingot has a flat defining a flat plane parallel to an original longitudinal axis of the original ingot, comprising:

marking a circular trace upon the original ingot using the flat as a reference, where the trace is centered upon a new longitudinal axis of the new ingot, where the new longitudinal axis is perpendicular to the flat plane and is perpendicular to the original longitudinal axis; and removing material outside the trace from the original ingot by cutting the original ingot, where each cut is made in a plane perpendicular to the flat plane.

12. The method of claim 11, further comprising cutting the original ingot into a plurality of sections, and removing material from each section to form a separate new ingot.

13. An ingot formed by the method of claim 11.

14. A silicon <110> ingot formed from a silicon <100> ingot by the method of claim 11.

15. A silicon <110> ingot formed from a silicon <111> ingot by the method of claim 11.

16. A method of forming a new ingot having a target orientation from an original ingot having an original orientation, comprising:

removing material from an original ingot using a flat formed in the original ingot as a reference to form a new ingot, where the flat defines a plane parallel to an original longitudinal axis of the original ingot, and where a new longitudinal axis of the new ingot is perpendicular to the flat and is perpendicular to the original longitudinal axis.

17. The method of claim 16, where the original ingot has a crystal orientation of <100> and the new ingot has a crystal orientation of <110>.

18. The method of claim 17, where the flat is a {110} face.

19. The method of claim 16, where the original ingot has a crystal orientation of <111> and the new ingot has a crystal orientation of <110>.

20. The method of claim 19, where the flat is a {110} face.

21. The method of claim 16, where the original ingot is a silicon crystal ingot.

22. The method of claim 16, where the original ingot is a float-zone ingot.

23. An ingot formed by the method of claim 16.

24. A silicon <110> ingot formed from a silicon <100> ingot by the method of claim 16.

25. A silicon <110> ingot formed from a silicon <111> ingot by the method of claim 16.

* * * * *